United States Patent [19]

Hemming et al.

[11] Patent Number: 4,496,950

[45] Date of Patent: Jan. 29, 1985

[54] ENHANCED WIDE ANGLE PERFORMANCE MICROWAVE ABSORBER

[76] Inventors: Leland H. Hemming, P.O. Box W, Santee, Calif. 92071; Gabriel A. Sanchez, 12636 Metate Ln., Poway, Calif. 92064

[21] Appl. No.: 399,155

[22] Filed: Jul. 16, 1982

[51] Int. Cl.[3] ..... H01Q 17/00

[52] U.S. Cl. ..... 343/18 A; 333/81 R

[58] Field of Search ..... 333/81 R, 22 R, 81 B; 343/18 A, 703; 338/217

[56] References Cited

U.S. PATENT DOCUMENTS

| | | | |
|---|---|---|---|
| 3,295,133 | 12/1966 | Emerson et al. | 343/18 A |
| 3,631,492 | 12/1971 | Suetake et al. | 343/18 A |
| 4,164,718 | 8/1979 | Iwasaki | 333/81 R |
| 4,218,683 | 8/1980 | Hemming | 343/18 A X |

FOREIGN PATENT DOCUMENTS

| | | | |
|---|---|---|---|
| 950073 | 10/1956 | Fed. Rep. of Germany | 343/18 A |

OTHER PUBLICATIONS

Teal et al., *Attenuator Materials for Microwaves*, Electrical Engineering Magazine, Aug. 1948, pp. 754–757.

*Primary Examiner*—Paul Gensler

*Attorney, Agent, or Firm*—Ralph S. Branscomb

[57] ABSTRACT

A microwave absorber is provided for use as lining in an anechoic chamber for positioning on the sides of the chamber, especially in the area about midway between the source and receiver, the absorber element being designed to augment chamber performance by effectively increasing the angle of incidence of radiation at the absorber, yielding an improved performance.

7 Claims, 12 Drawing Figures

ENHANCED WIDE ANGLE PERFORMANCE MICROWAVE ABSORBER

BACKGROUND OF THE INVENTION

The principal limitation in the design of microwave (radio frequency) anechoic chambers is the amount of suppression of sidewall reflection achievable with various absorbers and chamber geometry. The geometric design of an anechoic chamber is directly controlled by economic considerations. Generally speaking, the larger the chamber room, the greater is the thickness of the absorber material that can be used, and thus the higher is the performance of the chamber. However, the absorber material is very expensive, thus limiting the practical dimensions of the chamber. In addition, a cubicle chamber is more effective than a smaller chamber of the same length but having a narrower width. The ratio of the length to the width is referred to as the "aspect ratio." The higher the aspect ratio, the greater the angle of incidence of radiation on the sidewalls deviates from normal. At very shallow angles of incidence, the absorbing capability of the absorber material falls off dramatically.

There is a need therefore for a chamber geometry, and an absorber element which can be incorporated in such chamber geometry, which in effect re-orients the surface experienced by the radiation wave front as it impinges on the sidewalls of the chamber, effectively shifting the angle of incidence at such sidewall areas from a shallow angle to an angle more closely approaching orthonormal.

SUMMARY OF THE INVENTION

The absorber element and the chamber lined with such as disclosed and claimed herein comprises a basic wedge element which is arranged with other wedge elements to define a lining of the chamber wall which forms a series of planes that are canted toward the radiation source rather than lying parallel against the sidewall of the chamber. When placed with their large ends abutting, and aligned so that a single ridge is defined by the large ends, a series of canted planes is seen from both ends of the chamber.

Each element is made of a conventional absorber facing material, which is ordinarily foam sculptured to define a series of forward projections, and a base member behind the facing layer which is wedge-shaped to support the facing layer at the correct angle. The forward projections of the facing layer serve an impedance matching function, and progressing toward the back surface of the absorber element the layers are loaded with increasing levels of lossy material. This absorber unit provides the key to good microwave anechoic chambers by raising the degree of suppression achieved in the absorber material lining the sidewalls, ceiling and floor along the chamber axis.

Conventional approaches to the sidewalls reflection problem result in several design considerations. First, the chamber aspect ratio is held between 1.5:1 and 2.5:1. Thicker materials are used in the critical bounce or specular region, typically a patch of absorber having rough diamond shaped projections which are rotated 45° about their axis so that incoming radiation sees the edge of the diamond or pyramid first. Also, directive antennas are used as sources, minimizing the amount of energy reaching the walls in the first place.

These considerations are very limiting, however. The thickness on the sidewalls, floor and ceiling of the absorber material is limited by the aperture that is required to pass the radiation without diffraction. Also, rotating the absorber material 45° to orient the diamond-shaped projections edge-first requires special cutting and fitting, adding significantly to the expense of the installation. Finally, use of a directional antenna increases the amplitude taper across the test region. This is not desirable, since a plane wave or uniform wave front is ideal for illuminating the test region.

By utilizing the wedge-shaped absorber element in the pattern specified herein, all of these considerations are minimized in their negative impact on absorber performance level. Although the wedge does not result in bringing the wall services into an orthonormal relationship with impinging radiation, it brings the angle of incidence close enough to normal so that the performance does not fall off the curve, as it does when the angle of incidence decreases below about 40°.

BRIEF DESCRIPTION OF THE DRAWINGS

FIG. 9 illustrates the wedge with the pyramids aligned to meet the wave front edge-on;

DETAILED DESCRIPTION OF THE PREFERRED EMBODIMENT

Figure 1:
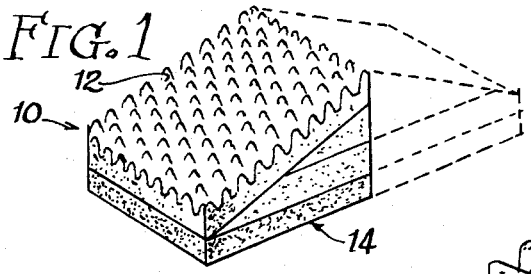
FIG. 1 is a perspective view of an absorber element.
Figure 2:
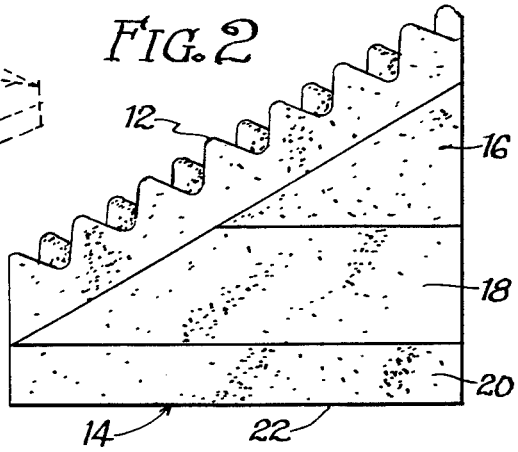
FIG. 2 is a section of the element shown in FIG. 1.

As shown in FIG. 1, the geometry of the absorber element is fairly elemental. The typical element has a body 10 with a scalloped front facing 12 and a base 14 which in the embodiment of the absorber indicated at 10 is made of three layers 16, 18 and 20 as shown in FIG. 2. The front layer 12 is a standard microwave impedance matching slab. The layers in the base and the facing slab are made of polyurethane foam which is loaded to various degrees with conductive carbon to make the material lossy to various degrees. A typical formulation would be 22% loading on the front face, and the top layer 16, 25% loading in the layer 18, and 35% loading in the bottom layer 20. These percentages represent the percentage of conductive carbon of the liquid which impregnates the foam, which is a mixture of a latex binder and the carbon. The purpose of the increased loading from the front to the back is of course to vary the impedance incrementally to prevent boundary reflection.

Figure 7:
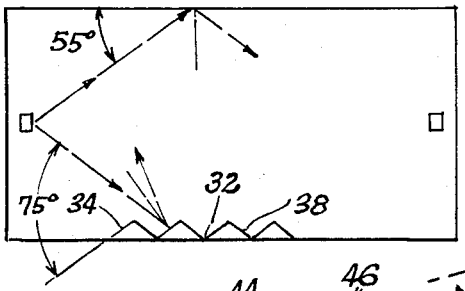
FIG. 7 illustrates the angular difference of incidence with and without the high angle absorber.

The absorber element 10 defines an angles at the facing slab 12 of about 30° with the back surface 22 of the absorber element. As shown in FIG. 7, by utilizing this element to cant the surface out 30° the angle of incidence is in effect increased 30°. As shown in FIG. 7, what would otherwise be a 50° shallow angle of incidence is converted to an 80° angle of incidence by the absorber wedge. The significance of this change in the angle of incidence can be appreciated by reference to the graph in FIG. 10. It can be seen that at an 80° angle of incidence, performance is not substantially affected, whereas at a 50° angle of incidence, there is a devastating increase in reflectivity of about 15 decibels.

Figure 10:
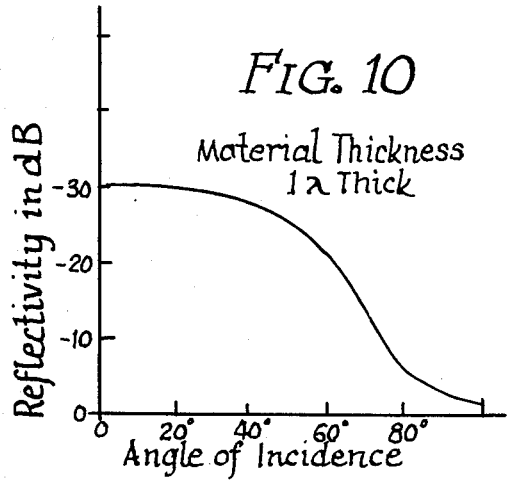
FIG. 10 graphs the performance of the absorber material as a function of increasingly shallow angles of incidence.
Figure 12:
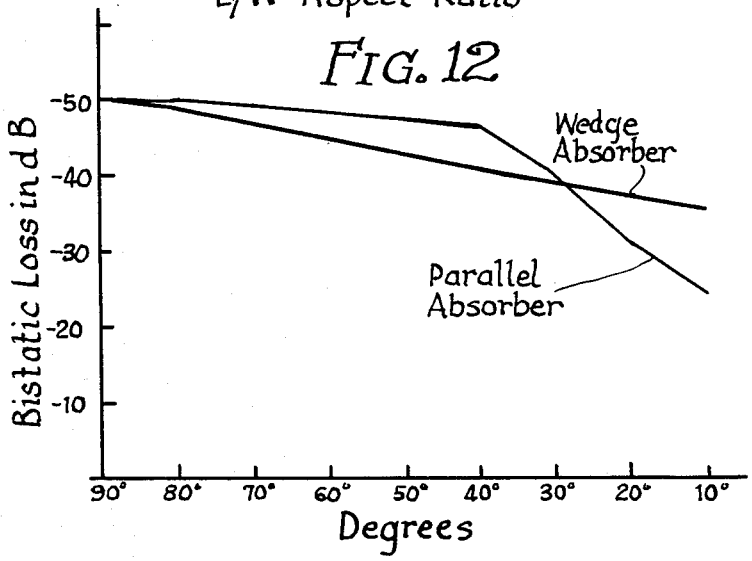
FIG. 12 graphs absorber effectiveness compared with the prior art.

A comparison of the wedge absorber with a flat slab absorber as thick as the thickest part of the wedge is shown in FIG. 12. Because the flat slab is thicker overall, head-on radiation is absorbed somewhat better. However, performance of the parallel-sided slab drops dramatically beginning at about a 40° angle of incidence, and at angles shallower than about 30°, the wedge-shaped absorbers are much more effective. It should be noted that FIG. 12 plots the results of an actual test utilizing the absorber element indicated at FIG. 1, whereas FIG. 10 represents a more theoretical curve applying to parallel-sided absorbers generally.

Figure 3:
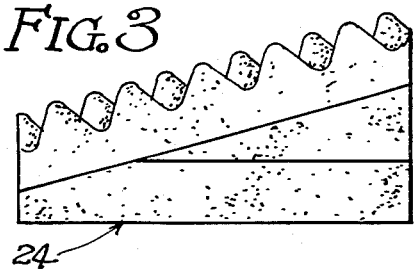
FIG. 3 is a section of a modified absorber element with a shallower angle.

FIG. 3 illustrates a modification 24 of the basic absorber unit which is similar to absorber element 10, but is thinner and defines a shallower angle. This absorber could be used in a chamber with a lower aspect ratio. For purposes of directional orientation in the claims, the bottom of the absorber as shown in FIG. 3 will be referred to as the "back surface" of the absorber, and that direction will be the rearward direction. The top of the absorber will thus be the front surface, and will also define a forward direction. The relationships in the claims do not require that the forward direction be identified as either perpendicular to the forward surface, or perpendicular to the rearward surface.

Figure 4:
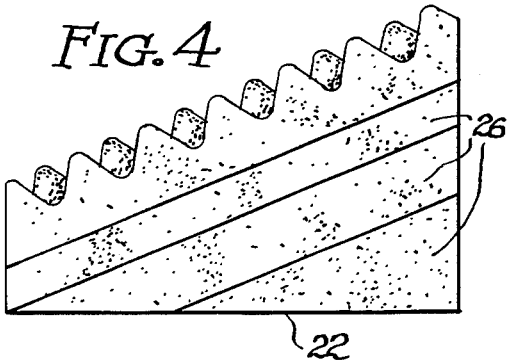
FIG. 4 is another modification having base layers parallel to the facing slab.

FIG. 4 illustrates yet another slight modification of the basic absorber element wherein the layers 26 of the base lie parallel to the front slab, rather than being parallel to the rear face 22 of the absorber.

Figure 5:
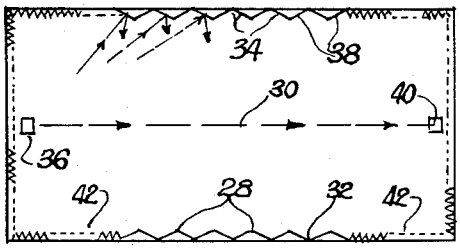
FIG. 5 is a horizontal section through a typical chamber arrangement illustrating the orientation of the lining.
Figure 6:
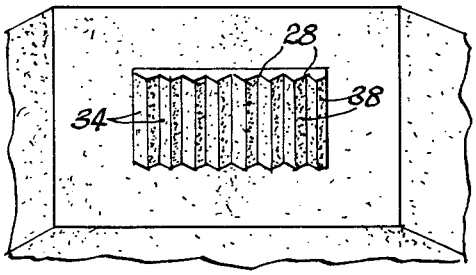
FIG. 6 is a perspective of a wall illustrating the positioning of the absorber element.

In FIGS. 5 and 6, a typical anechoic chamber configuration is illustrated using the wedge-shaped absorbers. The absorbers are placed with the thick ends together so that they define ridges 28 which run transversely with respect to the chamber axis 30. Between the ridges are valleys 32 defined by the narrower ends of the wedges, so that between the valleys and the ridges are a series of planes 34 directed toward the source 36, and in an alternating set of planes 38 which are directed more toward the receiving antenna 40. In the illustration, the wedge elements are only used in the side portions of the chamber where the greatest level of low-angled radiation would be experienced. Forward of the wedges aligned with the source the chamber would be normally lined with a more standard layer or layers of material 42.

Figure 8:
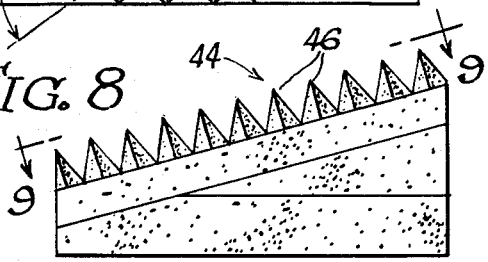
FIG. 8 illustrates a wedge using a pyramid facing.
Figure 9:
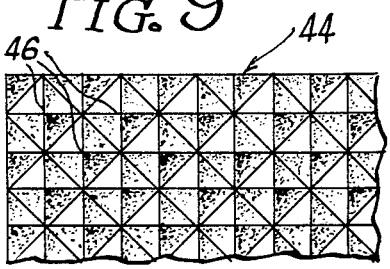

In FIG. 8, yet another embodiment 44 is shown wherein diamonds or pyramids 46 are used instead of the scallops of the facing slab 12 to match impedance between free space and the lossy absorber material. These pyramids are arranged as indicated in FIG. 9, with one set of their diagonals parallel with the chamber axis. As mentioned above, this configuration leads to less boundary reflection from the pyramids.

Figure 11:
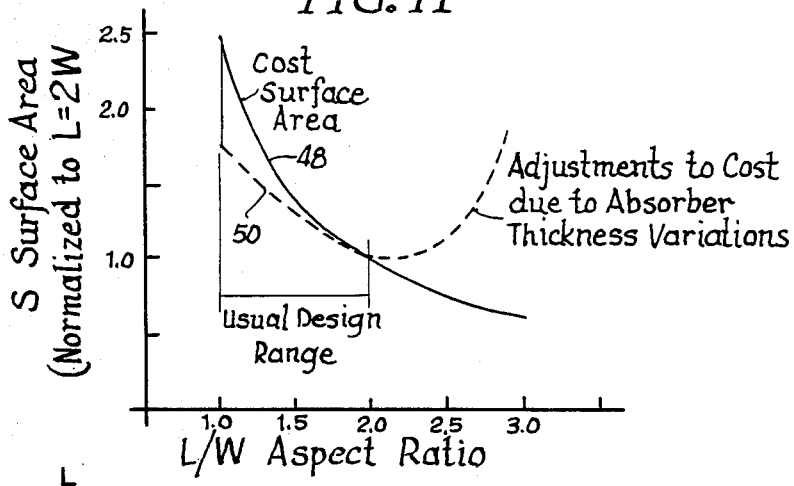
FIG. 11 illustrates the way in which the surface area, and thus the manufacturing cost, of an anechoic chamber varies with the aspect ratio; the graph presumes that the length of the room does not change, and only the height and width varies.

The benefit of the absorber disclosed and claimed herein can be appreciated from an economic sense by making reference to FIG. 11. This figure illustrates through curve 48 the surface area of the interior of an anechoic chamber as a function of the aspect ratio, while holding the length of the chamber to the same dimension. The cost of manufacturing the chamber is closely linked to the surface area, because the primary cost is the absorber material itself and the labor to install it.

It can be seen that naturally as the aspect ratio increases, the cost plummets. However, this curve is modified as shown at 50 (an approximation), indicative of the modification that would be required in the absorber thickness as the aspect ratio is changed. This graph is relevant to parallel-sided absorber materials. It can be seen that because of the increased cost of extra-thick absorber material that would be required, especially along the sides and ceiling of the chamber approximately centrally of the chamber axis, the lowest cost occurs for an aspect ratio of about 2.5, with the cost rising rapidly for increased aspect ratio. However, for utilization of the wedge-shaped absorbers, as indicated in FIG. 12 performance can be maintained without increasing the overall thickness of the material for higher aspect ratios, thus permitting the chamber to be constructed with a higher aspect ratio, further along the surface curve 48, and thus the chamber can be made at less expense through use of the wedges. The expense of construction is the ruling criterion in the anechoic chamber business. Chamber performance in isolation from the cost factor presents no problem whatsoever, as a larger and larger chamber could be constructed with thicker and thicker absorber material comprised of more and more layers until the performance level that is required is reached. Such a consideration is totally out of the question when put in an economic perspective, inasmuch as the chambers that are used currently run into hundreds of thousands of dollars, with an obvious dramatic increase in costs being inherent in any chamber motivated by perfection as a goal. With this in mind, the contribution of this simple absorber to the field of anechoic chamber construction can be fully appreciated.

While the preferred embodiment of the invention has been described, other modifications may be made thereto and other embodiments may be devised within the spirit of the invention and scope of the appended claims.

What is claimed is:

1. An enhanced wide angle performance microwave absorber element comprising:

(a) a generally wedge-shaped body having a back surface, and a generally plane-defining front surface striking an acute angle with said back surface to define a thick end and a thin end of said generally wedge-shaped body;

(b) said front surface defining a plurality of impedance matching projections projecting forwardly generally orthogonally from the plane defined by said front surface; and (c) said body being of greater microwave impedance adjacent said back surface than at said front surface.

2. Structure according to claim 1 wherein said front surface is defined on a facing slab and said body comprises a wedge-shaped base defining said back surface and with said facing slab being mounted on the front of said wedge-shaped base.

3. Structure according to claim 2 wherein said base is comprised of a plurality of laminations defined along planes parallel to said back surface, and said laminations are increasingly lossy toward said back surface.

4. Structure according to claim 2 wherein said base has a front surface defining an acute angle with said back surface and is comprised of a plurality of laminations defined along planes parallel to said front surface, and said laminations are increasingly lossy in the direction retreating from said front surface.

5. Structure according to claim 1 wherein said projections are four-sided pyramids arranged to define said front surface such that a plane passing through two diagonal edges of each of said pyramids intersects the plane generally defined by said front surface such that the line of intersection defines the line of greatest slope on the front surface of said wedge-shaped body.

6. Structure according to claim 1 wherein said wedge-shaped body is comprised of at least three matrix layers loaded with lossy materials to different degrees, with the layer defining said front surface having on the order of 22% loading, an intermediate layer having on the order of 25% loading, and the layer defining said back surface having on the order of 35% loading.

7. In an anechoic chamber with a central cavity and defining an axial direction between the test source and receiver and at least one sidewall lying generally parallel to said axial direction, an enhanced wide angle absorber lining covering at least a portion of said sidewall comprising:

(a) a plurality of generally wedge-shaped elements having a thick end and a thin end, said elements abutted at the thick ends to define a series of ridge rows, and said ridge rows lying transverse to the axis of said chamber;

(b) each of said wedge-shaped elements being comprised of a plurality of consecutive layers of increasingly lossy loading from the central area of said chamber toward the rear surface therein and, (c) each of said rows defining a front facing angled toward said test source to increase the angle of incidence of radiation therefrom, with said front facing defining a plurality of impedance matching projections in the shape of four-sided pyramids with the planes defined by two diagonal edges of said pyramids parallel to said axial direction.

* * * * *